United States Patent [19]

Uy

[11] Patent Number: 4,493,126

[45] Date of Patent: Jan. 15, 1985

[54] SCRAPING BRUSH

[76] Inventor: William C. Uy, 9 Queens Ct., Wilmington, Del. 19808

[21] Appl. No.: 338,587

[22] Filed: Jan. 11, 1982

[51] Int. Cl.[3] ..... A46B 15/00

[52] U.S. Cl. ..... 15/186; 15/159 A; 15/200; 15/236; 51/400

[58] Field of Search ..... 15/197, 198, 200, 159 A, 15/230.16, 236, 104.18, 93 R-93 C, 186-188; 51/334, 335, 336, 337, 400; 299/39; 29/81 G, 81 J

[56] References Cited

U.S. PATENT DOCUMENTS

| | | | |
|---|---|---|---|
| 525,699 | 9/1894 | Enochs | 15/104.18 |
| 1,694,018 | 12/1928 | Mudge et al. | 15/198 X |
| 1,946,283 | 2/1934 | Hoffman et al. | 128/62 A |
| 2,973,539 | 3/1961 | Buehrle | 15/179 |

FOREIGN PATENT DOCUMENTS

| | | | |
|---|---|---|---|
| 2652716 | 5/1978 | Fed. Rep. of Germany | 15/200 |
| 329114 | 5/1903 | France | 15/104.18 |
| 1371636 | 6/1964 | France | 15/181 |
| 2355479 | 1/1978 | France | 15/200 |

*Primary Examiner*—Peter Feldman

[57] ABSTRACT

A scraping brush with the free ends of the bristles having feet or disc shaped terminal members, which provide the latching or anchoring surfaces by which paint scales or other scales are pried or pulled loose when the scraping brush, in which the bristles are attached, is swept over the scales.

1 Claim, 35 Drawing Figures

SCRAPING BRUSH

REFERENCES: U.S. PATENT DOCUMENTS

U.S. Pat. No. 2,980,937, 4/1961 Defries, 15/236
U.S. Pat. No. 3,250,000, 5/1966 Schumann, 15/236
U.S. Pat. No. 3,530,524, 9/1970 Clemans, 15/236
U.S. Pat. No. 3,670,414, 6/1972 Stecker, 15/236

BACKGROUND OF THE INVENTION

This invention relates to a scraping brush for removing dried paint scales or other protruding but partially attached particles from flat or contoured surfaces, wherein the free ends of the relatively stiff bristles have feet which provide the latching or anchoring surfaces by which such scales or particles are pried or pulled loose. Such a scraper is also effective in removing scales in any direction of motion.

One problem with ordinary brushes is that the bristles ends have no means to hook onto scales and so would glide over scales. On the other hand, in known flat blade scrapers, the firm and sharp scraping blades, though capable of removing stubborn scales, work only in a back-and-forth motion and are too rigid to follow the contour of irregular surfaces. See, for examples, U.S. Pat. Nos. 2,980,937, 3,250,000, 3,530,524, and 3,670,414.

SUMMARY OF THE INVENTION

The object of the invention is to remove surface scales from flat, irregular or contoured surfaces. Examples are the removal of dried paint scales, of wood splinters, of welding scales, of fish scales, etc. My invention accomplishes this object by providing a multitude of relatively stiff bristles, formed preferably of wire, connected to a base wherein the free end of each bristle has a foot, whose planar surface is at an angle to the bristle longitudinal axis, and whose outermost dimensions are larger than the immediate diameter or width of the bristle end to which the foot is attached. In a common bristle, its end is a simple cut end of a cylinder without any protrusion or projection. In my invention, however, the end of each bristle has a foot or disc shaped terminal end member which extends radially outward from the bristle. It is these feet or disc members, which provide the latching or anchoring points or surfaces, as they can also get beneath scales, by which the surface scales are pried or pulled loose as the scraping brush is swept over the scales. Because each bristle and its foot operate independently from other bristles and their feet, they can separately follow the contour of irregular surfaces. With such feet facing in all directions, such a bristle scraping brush is effective in removing scales in any direction of motion versus the back-and-forth motion of known flat blade scraper.

The foregoing and the object of this invention will become apparent in the following descriptions and drawings.

DETAILED DESCRIPTION OF THE INVENTION

Figure 1:
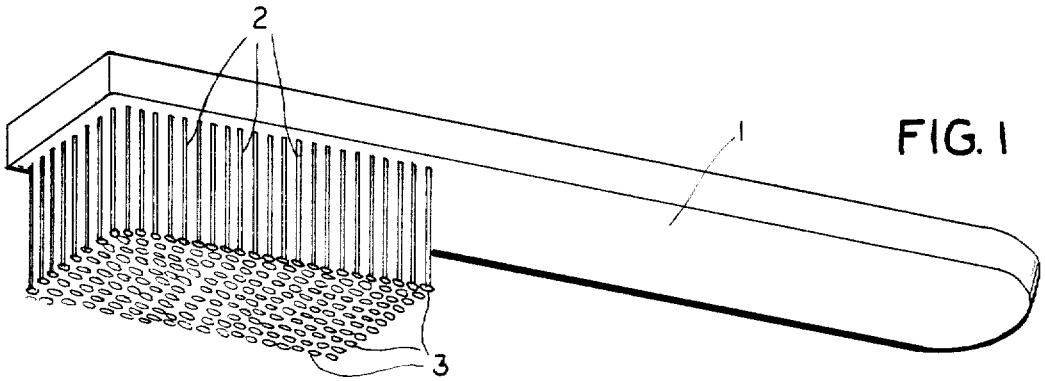
FIG. 1 is a perspective view of the scraping brush of this invention.
Figure 2:
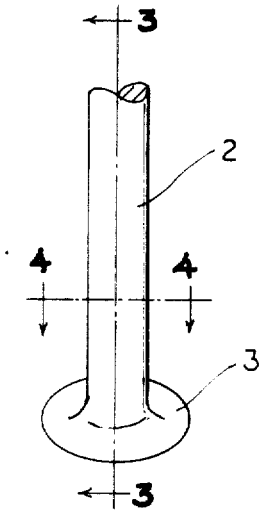
FIG. 2 is an enlarged view in perspective of the novel end portion of a bristle for the scraping brush in this invention showing a foot or disc shaked member at the end of the bristle.
Figure 3:
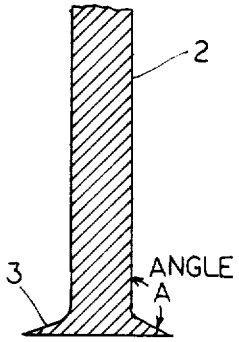
FIG. 3 is a cross-sectional view taken on line 3—3 of FIG. 2.
Figure 4:
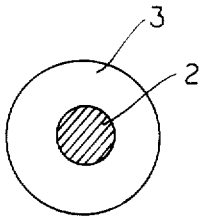
FIG. 4 is a cross-sectional view taken on line 4—4 of FIG. 2.
Figure 5:
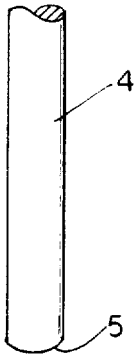
FIG. 5 is an enlarged view in perspective of the end portion of a common bristle.
Figure 6:
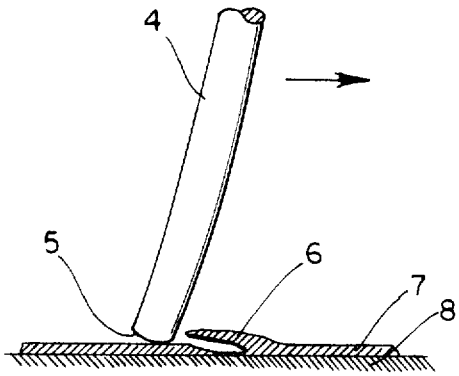
FIG. 6 is an enlarged view of the end portion of a common bristle as shown in FIG. 5 in relation to an enlarged cross-sectional view of a scale.
Figure 7:
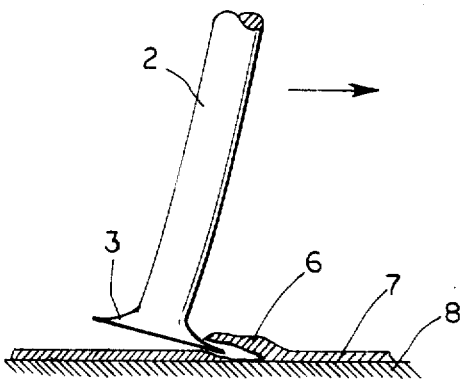
FIG. 7 is an enlarged view of the novel end portion of a bristle as shown in FIG. 2 showing the operation of the foot, whose peripheral surfaces have gotten beneath a scale.
Figure 8:
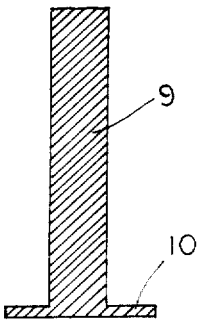
FIGS. 8–25 are enlarged views in cross-section, along similar view direction as in FIG. 3, showing different foot geometries, other than the one shown in FIG. 3, at the end of a bristle.
Figure 9:
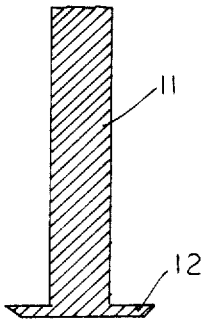
Figure 10:
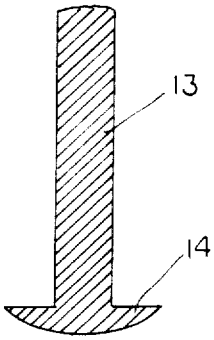
Figure 11:
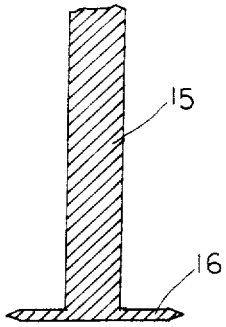
Figure 12:
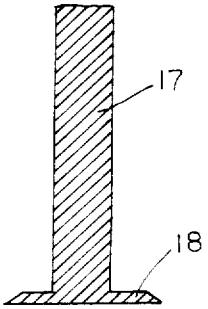

A scraping brush of this invention is shown in FIG. 1. This device includes a base 1 to which a multitude of relatively stiff bristles 2 are attached. The base to which the bristles are attached may have the shape of a cylinder with the bristles attached to the inside or outer surface thereof. Alternatively, the base may be curved with the bristles attached to the curved surface. The bristles cross section may be circular or polygon. The free end of each bristle 2 has a foot or disc shaped member 3, as shown in FIG. 2 and in cross-sectional view in FIG. 3. The foot 3 extends radially out from bristle 2 and its outermost dimension is larger than the diameter of the end of the bristle 2 to which the foot 3 is attached to or a part of. As shown, each disc shaped terminal member is integrally formed on the end of the bristle and defines a thin, flat, end member having a bottom plane in the shape of the circular face. The axis of bristle 2 forms an angle A, which may be acute or obtuse, with the line tangent to the top surface of the cross-section of foot 3 as shown in FIG. 3. The foot 3 in FIG. 3 is shown to taper to a sharp edge and has a circular geometry as shown in FIG. 4. This novel end portion called "foot" is compared to the ordinary end 5 of a common bristle 4 shown in FIG. 5. FIG. 6 shows the end 5 of a common bristle 4 as it is moving in the direction of the arrow toward a scale 6, shown in cross-sectional view, attached to layer 7, which in turn is attached to substratum 8. Having no means to hook onto the scale 6, the common bristle 4 will just glide over scale 6. On the other hand, FIG. 7 shows the operation of the novel foot 3 on bristle 2. The foot 3 surface provides the means for hooking the scale 6 or, as shown in FIG. 7, the foot 3 can get beneath the scale 6 and pull scale 6 loose as the brush, in which bristle 2 is attached, is moved in the direction of the arrow.

Figure 13:
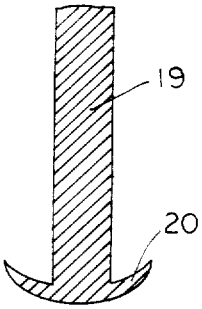
Figure 14:
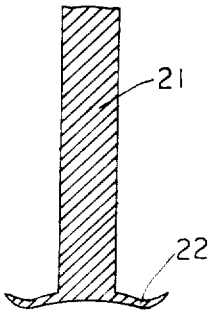
Figure 15:
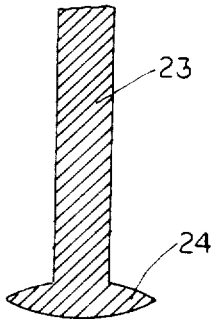
Figure 16:
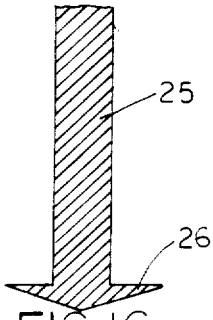
Figure 17:
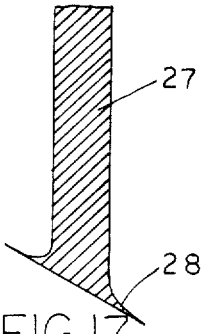
Figure 18:
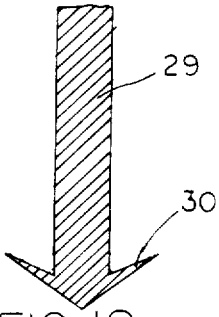
Figure 19:
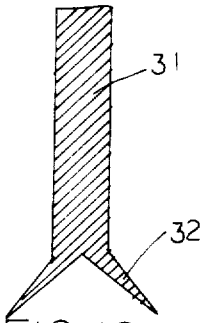
Figure 20:
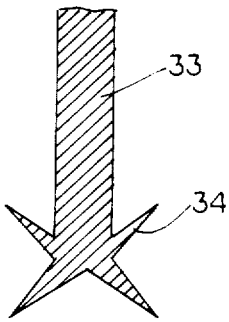
Figure 21:
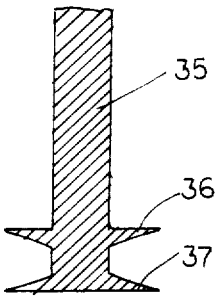
Figure 22:
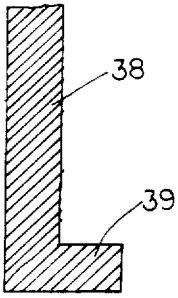
Figure 23:
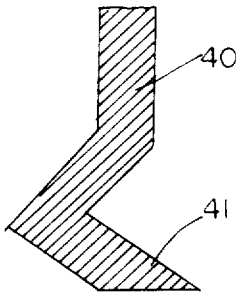
Figure 24:
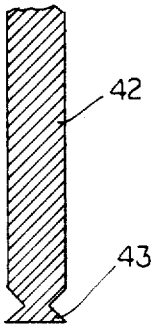
Figure 25:
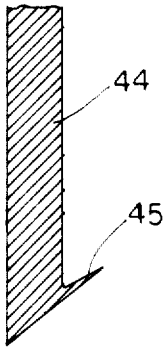
Figure 26:
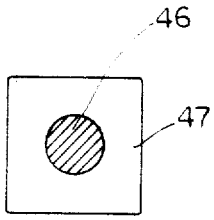
FIGS. 26–34 are enlarged top views, along similar view direction as in FIG. 4, showing the cross-section of a round bristle and different foot geometries.
Figure 27:
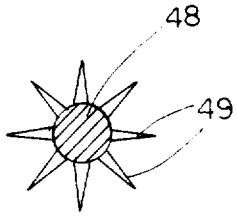
Figure 28:
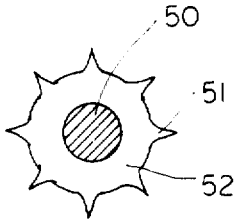
Figure 29:
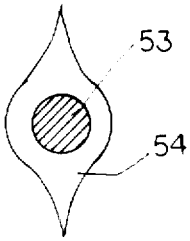
Figure 30:
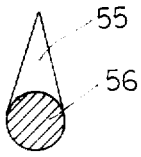
Figure 31:
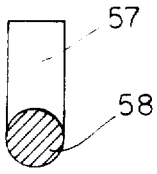
Figure 32:
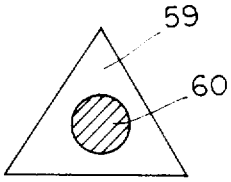
Figure 33:
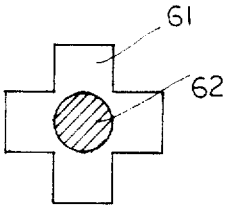
Figure 34:
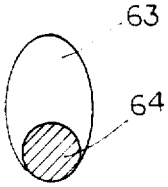

Although the preferred geometry of a foot, shown in different direction of views in FIGS. 2, 3, and 4, has a flat bottom surface, is circular and thin with a sharp edge, other examples of different geometries for the foot are shown in FIGS. 8 to 33. These examples are not intended to be exhaustive but serve to show other geometries which fulfilled the same functions of a foot. The shape of these feet, as viewed along the bristle axis toward the foot can either be circular, square or other polygon. If it is circular, the foot 20 in FIG. 13 has the shape of a bowl, foot 30 in FIG. 18 an upright cone, foot 32 in FIG. 19 an upside down cone. The number of foot per bristle need not be limited to one but there may be more than one tier of foot such as shown in FIGS. 20 and 21. The foot 34 in FIG. 20 can have the shape of two cones or two foursided pyramids joined at their pointed tips. A foot need not be a continuous surface and can consist of spikes which may be sharp or non-sharp pointed spikes. The spikes foot 49 in FIG. 27 are attached to the bristle 48 but in FIG. 28, the spikes 51 are attached or formed from a continuous surface. Although it is also preferable for a foot to be symmetric to the bristle axis, it can also be non-symmetric as in FIGS. 22, 23, 25, 30, 31, and 34.

Figure 35:
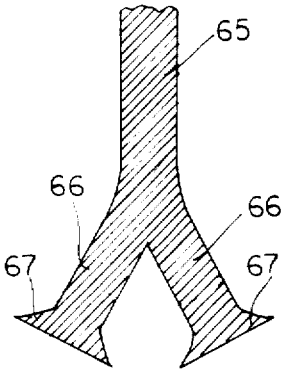
FIG. 35 is an enlarged view in cross-section, along similar view direction as in FIG. 3, showing a bristle branching into two legs, whose free ends have a foot each.

Each bristle may branch out into 2 or more legs. The free end of each leg having a foot. In FIG. 35, the bristle 65 has two legs 66, each of which has foot 67.

The preferred spacing between bristles in a brush scraper depends on the outermost dimension of each foot. The bristles should be spaced preferably so that the foot surfaces do not overlap each other. It will be obvious of course, that some of the bristles present in the brush scraper may not have feet. The bristles and feet are preferably made of the same material, relatively stiff and strong. Metallic materials are preferable over plastics for strength, stiffness, and good abrasion properties. The base 1 may be made of plastic or wood or other rigid material commonly used for this purpose.

What is claimed is:

1. A scraping brush comprising a handle and a base, said base having a plurality of stiff wire bristles extending perpendicularly therefrom, each of said bristles having an integrally formed, thin, flat, disc shaped terminal end member thereon defining a flat circular face, the bottom plane of the flat circular face being perpendicular to the longitudinal axis of its integral bristle, the cross-sectional thickness of each of said disc shaped terminal end members tapering radially to a sharp point, the cross-sectional area of each of said disc shaped terminal end members being taken on a plane coinciding with the longitudinal axis of the bristle.

* * * * *